United States Patent [19]

McAlarney

[11] 3,952,455

[45] Apr. 27, 1976

[54] SEALING GASKET

[75] Inventor: Fred R. McAlarney, Seymour, Ind.

[73] Assignee: The Pantasote Company, Greenwich, Conn.

[22] Filed: Jan. 20, 1975

[21] Appl. No.: 542,392

[52] U.S. Cl. ..... 49/497; 49/498

[51] Int. Cl.[2] ..... E06B 7/16

[58] Field of Search ..... 49/497, 498, 485, 475

[56] References Cited

UNITED STATES PATENTS

| | | | |
|---|---|---|---|
| 2,908,949 | 10/1959 | Frehse | 49/497 |
| 3,378,956 | 4/1968 | Parks et al. | 49/497 X |
| 3,466,804 | 9/1969 | Swaneck, Jr. | 49/498 X |

*Primary Examiner*—Philip C. Kannan

[57] ABSTRACT

A resilient, honey-comb gasket for refrigerator doors and the like has a stiff base member, an outer wall over said base member, an oblong central cell extending from the base member to said outer wall and a pair of upwardly diverging arms connecting the central cell to the outer wall.

10 Claims, 4 Drawing Figures

SEALING GASKET

This invention relates to resilient gaskets formed of plastic material, and more particularly to gaskets for effecting a compressive seal between two relatively movable members.

While gaskets embodying the invention may advantageously be employed for various purposes, they provide exceptional advantages when used in refrigerators between the door and the cabinet, and hence they will be discussed in connection with such use.

A gasket for this purpose should perform several functions and satisfy several important requirements. It should cushion the door on closing, prevent passage of air through the junction between the door and the cabinet after the door has been closed, and provide heat insulation at such junction. It should perform these functions even though there are irregularities in the surfaces of either or both the door and the cabinet at the junctions.

Moreover, the sealing gasket should provide an effective seal and heat barrier, notwithstanding surface irregularities, despite the fact that when the door is closed and opened the gasket in the vicinity of the hinge is subjected to forces extending transversely of the gasket which tend to impart a wiping action to the gasket. This condition is more pronounced when the hinge support for the door is one in which the axis of the hinge pivot is substantially offset from the plane of the cabinet surface to be contacted and sealed by the gasket, as is usually the case in modern refrigerators. These transverse forces and the tendency toward the wiping action occur because, as the door approaches its closed position, the offset pivot axis causes the gasket-supporting surface of the door in the vicinity of the hinge to move transversely of the surface of the cabinet against which the gasket is to press. Such transverse movement may approach 50% of the perpendicular movement during the last few degrees of swinging movement of the door on closing. Unless special precautions are taken, as in the gasket of the invention, the sealing wall of the gasket in the vicinity of the hinge will wrinkle or become abraded; its sealing and heat insulation actions will be largely, if not completely, impaired.

In addition to all of the above, the gasket should maintain its resiliency, and should rapidly recover its uncompressed shape when the refrigerator door is opened, throughout a long life, so that it can fully perform the above indicated functions for a long period of use without replacement. It is also necessary that the gasket should be capable of manufacture and installation at competitive low costs.

Refrigerator sealing gaskets are, of course, well known, such as U.S. Pat. No. 3,178,778, which discloses the Y-gasket and U.S. Pat. No. 2,908,949, which discloses the H-gasket. Despite the advantages of these gaskets, there have been difficulties encountered in their economic manufacture.

Such gaskets have been made with a quite thin outer wall, say 0.015 to 0.017 inches, in order to provide sufficient recovery after compression. Thin walls are difficult to manufacture and present packaging problems. When two strips of gasket are joined together by splicing to provide a rectangular door gasket, the thin outer wall has a tendency to form holes, thus causing rejects. If a thicker outer wall is used, the recovery from compression is adversely affected, since the thicker wall is stiffer than the thinner wall.

The design of a gasket is empirical, and due to the several requirements of the gasket in use and in manufacture, a suitable gasket is quite difficult to obtain. Despite these difficulties, a new approach to gasket design has been developed by the present invention, which provides a resilient flexible sealing gasket having an outer cell wall spaced upwardly from a base member and an oblong inner central cell longitudinally extending from the base toward the outer wall, the inner cell having a pair of upwardly diverging arms on opposite sides of its cell wall connecting the cell wall of the inner cell with the outer cell wall.

Preferably, the central cell is substantially elliptical with the major axis of the ellipse extending longitudinally away from the base toward the outer cell wall.

This new construction overcomes the two major problems confronting refrigerator gaskets, namely compression set and distortion due to wiping action. The central cell is not unlike a bulb or balloon, and cooperates with the outer cell wall to provide excellent recovery from compression. Since the outer cell wall is not being relied on as the exclusive, or major, source of recovery, a thicker outer cell wall can be used, which in turn is easier to seal by conventional heat sealing than the thinner walls previously used. The thicker wall thus allows the heat sealing operation to proceed with much fewer rejects due to holes, etc. than were encountered with the prior art thinner outer cell wall. In addition, wider variations in thickness of the outer cell wall can be tolerated, thus reducing rejects based on excessive thickness.

The upwardly diverging arms connecting the inner central cell to the outer cell wall provide the gasket with the required resistance to distortion from hinge wipe. The arms may be straight, but preferably they are curved downwardly toward the base and then upwardly toward the outer wall, as a bow, so as to assist in the recovery of the gasket from compression. The position of the arms on the inner central cell affects the flexibility and recovery characteristics of the gasket. As the arms are positioned downwardly of the central cell, the flexibility is increased but the recovery decreased. Preferably, the arms are at substantially the midpoint of the cell.

The present invention is illustrated in terms of a preferred embodiment in the drawings, in which.

Figure 1:
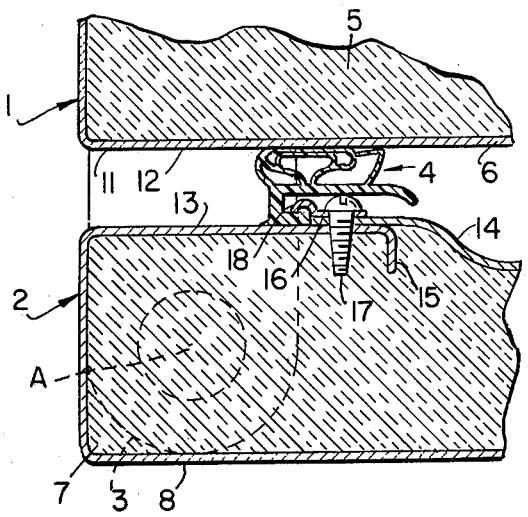
FIG. 1 is a fragmentary horizontal sectional view of a portion of the front hinged side of a refrigerator, showing the cabinet, the refrigerator door, and a gasket according to the invention, with the door completely closed and the gasket compressed in sealing relation.

FIG. 1 shows portions of a conventional home refrigerator comprising a cabinet 1 and a door 2 hingedly supported at one edge of the cabinet by hinge means 3, to swing horizontally about the vertical axis A. The door carries a gasket 4 embodying the invention. The refrigerator cabinet 1 is constructed in the usual manner with a thick layer of insulating material 5 covered by an outer sheet steel shell 6, and the door 2 is similarly constructed in the conventional manner with a relatively thick insulating layer 7 covered by an outer sheet steel shell 8.

The shell 6 of the cabinet 1 has a flat vertical wall portion 11 extending completely around the door opening to provide planar sealing surface 12 adapted to be engaged by the gasket 4 in sealing relation; the axis A of the hinge means is substantially offset from or spaced in front of this surface. The inner wall of the door shell 8 includes a flat outer peripheral portion 13 and a panel 14 which peripherally overlaps the latter. The wall portion 13 of the door shell 8 is substantially parallel to the wall portion 11 of the cabinet when the door is latched in its fully closed position, as shown in FIG. 1. When the door is in this position, there is a relatively wide space between the wall portions 11 and 13 of the cabinet and door, which space may have a horizontal width of ½ inch or more in a standard size refrigerator.

A stiffening flange 15 on and integral with the portion 13 of the door shell extends towards the inside of the door and the overlapping edges of the portions 13 and 14 are covered by and carry a sheet metal gasket-holding strip 16 which extends entirely around the door opening to hold the gasket 4 in place. The strip 16 is held in place by screws 17 which are threaded into and also hold together the overlapping edges of the metal wall portions 13 and 14. The gasket-holding strip 16, of uniform cross section, is flat for a major portion of its width, but has a rolled or flanged edge portion 18 of generally arcuate hook-shaped cross section extending outwardly beyond the edge of the wall panel portion 14 for clamping the gasket 4 in place. The rolled edge of the clamping strip provides a channel which receives an edge bead formed integrally on the gasket, locks the latter in predetermined position on and relative to the door, as will appear.

With the exception of the gasket 4, the refrigerator structure described above is conventional.

Figure 2:
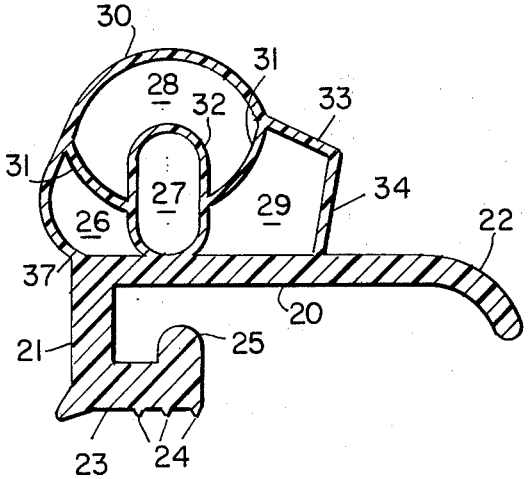
FIG. 2 is a sectional view to an enlarged scale showing the cross section of the gasket of FIG. 1 before installation.

The gasket 4 of the invention, of which the cross section throughout its length is shown enlarged in FIG. 2, is shaped to function effectively and satisfy all requirements outlined above when made in one piece as an extrusion of one of the pliable plastic materials generally used for refrigerator gaskets, such as homopolymers of vinyl chloride, copolymers of vinyl chloride and vinyl acetate, polyethylene, polyurethane, or similar extruded plastic materials having the necessary flexibility. Various rubbers and rubbery compositions may also be used. The preferred pliable plastic gasket material is a flexible polyvinyl chloride composition embodying a suitable plasticizer and other compounding ingredient such as pigments, fillers, antioxidants, heat and light stabilizers and the like as is well known in the art. The plasticizers preferably include a monomeric plasticizer such as dioctylphthalate, dioctyladipate or the like and/or a polymeric plasticizer such as polyethylene sebacate or the like. As used hereinafter, the term "plastic" when applied to the material of which the gasket is formed is intended to refer to such materials.

FIG. 2 shows the extruded plastic gasket in its normal unstressed condition prior to being mounted on the door 2. For convenience in description of the structure of this gasket, references to directions will be understood as referring to this figure. The gasket is of hollow tubular construction and comprises a substantially flat, stiff generally horizontal wall or base 20 of substantial thickness, having along one edge a downwardly extending anchoring section 21 of generally L-shaped cross section and along its other edge and spaced from the anchoring section, a downwardly extending generally inclined sealing flange 22 with its outer edge generally in alignment with flat lower portion 23 of the anchoring section. This lower portion 23 has on its underside several downwardly projecting ribs 24 adapted to bear in sealing relation against the wall portion 13 of the door, and an upwardly projecting relatively thick fastening rib 25 adapted to be clamped by the hook-shaped portion 18 of the gasket holding strip 16 to hold firmly the gasket 4 in place on the door, as shown in FIG. 1.

The base 20 of gasket 4 supports four air chambers 26, 27, 28 and 29 defined by relatively thin, flexible walls 30, 31, 32, 33 and 34. In particular, the central, generally elongated chamber 27 is defined by the central wall 32 of generally oblong cross section, such as the substantially elliptical cross section shown. Connecting the elongated chamber 27 to the curved wall 30 are branch walls 31, which curve upwardly toward wall 30. Along one side edge of the curved wall 30 is a generally transversely extending downwardly inclined upper side wall portion 33 joined along a continuous common juncture at its inner edge to the curved wall 30 and to one of the divider walls 31. At its outer edge, the upper side wall portion 33 is joined integrally to lower side wall portion 34. The lower edge of wall portion 34 is affixed integrally to the base 20, the wall portion 34 extending upwardly from the base and preferably being inclined outwardly.

The juncture between upper side wall portion 33 and its associated lower side wall portion 34 takes the form of an abrupt corner; while this juncture may be curved, e.g. as a continuation of curved wall 30, the abrupt corner is preferred since it better localizes deformation resulting from changes in the positions of joined wall portions 33 and 34 relative to each other. Wrinkling of sealing walls while and after the door closes is thus avoided. The corner angle also tends to increase the shape-retaining forces developed within the gasket by inherent resiliency on release of sealing compression.

The action of the gasket in cushioning closing of a refrigerator door, sealing against passage of air and providing a heater barrier after the door has been closed, is illustrated in FIG. 1. When the refrigerator door is closing, the outwardly curved central or top wall 30 of the gasket first contacts the wall surface 12 of the refrigerator cabinet at the hinge side of the door opening. As the door swings further to its completely closed position, shown in FIG. 1, the gasket is subjected to the previously mentioned transverse forces. However, due to its construction, the gasket yields transversely while contriving to exert forces resiliently resisting distortion and compression, and thus providing a good seal.

The structure of the gasket thus prevents leakage of air or impairment of heat insulation properties which could result from wrinkling, or abrasion and wear, of the gasket at the hinge of the door on closing. The transverse distortion of the gasket at the hinge side of the refrigerator opening when the door is in its closed position does not prevent a good seal. There is a wide area of gasket making good sealing contact with the cabinet, as shown in FIG. 1. The outwardly curved arcuate top wall 30 facilitates fitting of the wall material over and into irregularities in the confronting surface of the wall portion 11.

It will be apparent that the advantages of gaskets embodying the invention will be most fully realized if the gasket size and shape is selected in view of the space present between the door and the cabinet of the refrigerator, and the amount of the hinge offset.

Figure 3:
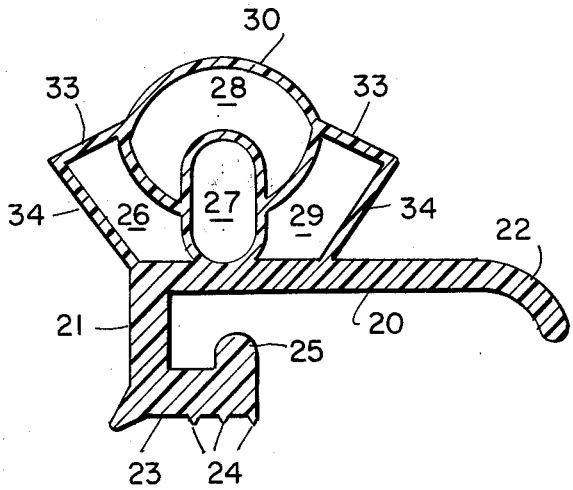
FIG. 3 is a sectional view, similar to that of FIG. 2 showing the cross section of a modified form of a gasket embodying the invention.
Figure 4:
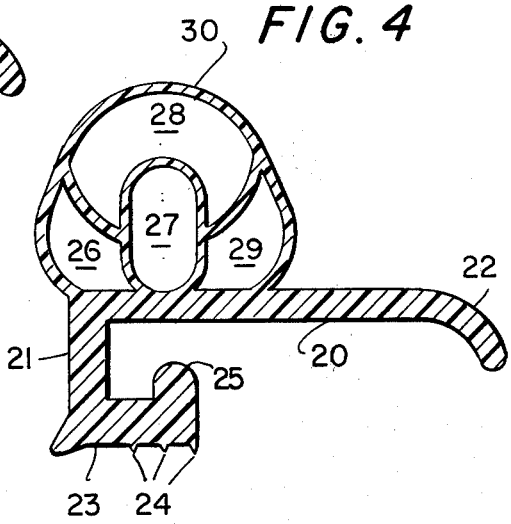
FIG. 4 is a sectional view, similar to FIGS. 2 and 3 showing the cross section of another modified form of a gasket embodying the invention.

FIGS. 3 and 4 show alternative embodiments of the invention wherein in FIG. 3 both of the side chambers 26 and 29 have the abrupt corners formed by wall portions 33 and 34, and in FIG. 4 curved wall 30 extends over chambers 26, 28 and 29.

The advantages of the gasket of the invention over the prior art gaskets are demonstrated by the following Example.

Example

A gasket having the configuration shown in FIG. 2 and a Y-gasket according to U.S. Pat. No. 3,178,778 were prepared and tested to determine their flexibility and compression set. In these tests, a piece of gasket 10 inches long is loaded at ½ pound per inch and the distance moved by the end of the gasket is measured at 24 and 240 hours. The compression set is measured by maintaining the gasket perfectly flat, i.e. totally collapsed, for 7 days, and the per cent recovery of the original height is measured 10 minutes after removal of the weight holding the gasket flat. The results are reported in Table I below:

Table I

| | Y-Gasket | Present Invention |
|---|---|---|
| Thickness of outer wall (in.) | 0.015–0.017 | 0.017–0.019 |
| 24-hour deflection (in.) | 0.078 | 0.116 |
| 240-hour deflection (in.) | 0.065 | 0.082–0.086 |
| Recovery from set (%) | 86.3 | 87.8 |

As can be seen from Table I, the gasket of the invention, despite its thicker outer wall, is more flexible than the thinner wall Y-gasket, while still meeting the General Electric refrigerator specification of 0.065 inches minimum to 0.135 inches maximum for the deflection test. Further, the recovery from compression set is improved by 1.5%. This is a significant figure, since it means that the loss due to compression set is reduced from 13.7 to 12.2%, or almost a 10% reduction. In use, the gasket of the invention provided an excellent seal under all conditions, including hinge wipe action.

Those skilled in the art will appreciate that the embodiments shown are for purposes of explanation and illustration and that various other changes and modifications can be made in the disclosed embodiments of the invention without departing from the spirit and the scope thereof. The essential characteristics of the invention are described in the appended claims.

I claim:

1. A hollow flexible sealing gasket having a uniform cross section throughout its length, said gasket being formed of plastic material and comprising in its normal unstressed condition a relatively stiff base member;

an outer cell wall extending upwardly from said base member and having spaced side wall portions and a top wall portion;

an inner central cell wall extending upwardly from said base member, said inner central wall having spaced side wall portions and a curved top wall portion, the top wall portion of said inner central cell wall curving forward and spaced from said top wall portion of said outer cell wall, said inner central cell wall defining an oblong central cell extending longitudinally upwardly from said base member;

two upwardly diverging, inner divider cell walls, each divider cell wall extending from a side wall portion of said inner central cell wall to said outer cell wall;

all of said cell walls being flexible and substantially more flexible than said base member, said cell walls defining said oblong central cell, a pair of side cells on either side of said oblong central cell, and a top cell above said oblong central cell and said side cells.

2. The gasket according to claim 1, wherein said inner central cell wall is substantially elliptical.

3. The gasket according to claim 1, wherein said divider cell walls extend from substantially the midpoint of said side wall portions of said inner central cell wall.

4. The gasket according to claim 3, wherein said divider cell walls are curved and bow outwardly toward said base member.

5. The gasket according to claim 1, wherein said divider cell walls are curved and bow outwardly toward said base member.

6. The gasket according to claim 1, wherein said outer cell wall has a curved side wall and top wall portions running from one edge of the base member to the upper edges of both divider walls, and the other side wall portion thereof provides an abrupt corner portion running from the upper edge of one said divider wall to the base member.

7. The gasket according to claim 1, said outer cell wall has a curved top wall portion running between the upper edges of the divider walls, and the side wall portions thereof provide abrupt corner portions running from each upper edge of each divider wall to the base member.

8. The gasket according to claim 1, wherein said outer cell wall is a curved wall.

9. The gasket according to claim 1, wherein the divider cell walls are at least substantially symmetrically disposed about a line passing longitudinally through said central cell.

10. The gasket according to claim 1, wherein said plastic material is a polymer of vinyl chloride.

* * * * *